US007972151B2

(12) United States Patent
He et al.

(10) Patent No.: US 7,972,151 B2
(45) Date of Patent: Jul. 5, 2011

(54) ELECTRICAL CONNECTOR WITH IMPROVED ARRANGEMENT OF GROUND AND SIGNAL CONTACTS

(75) Inventors: Jia-Yong He, Kunshan (CN); Qi-Sheng Zheng, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 135 days.

(21) Appl. No.: 12/501,035

(22) Filed: Jul. 10, 2009

(65) Prior Publication Data

US 2010/0173529 A1 Jul. 8, 2010

(30) Foreign Application Priority Data

Jan. 5, 2009 (CN) ..... 2009 1 0300064

(51) Int. Cl.
*H01R 13/648* (2006.01)

(52) U.S. Cl. ..... 439/108; 439/660

(58) Field of Classification Search ..... 439/108, 439/79, 80, 660
See application file for complete search history.

(56) References Cited

U.S. PATENT DOCUMENTS 4,157,612 A * 6/1979 Rainal ..... 29/828
6,220,896 B1 * 4/2001 Bertoncini et al. ..... 439/607.1
6,280,204 B1 * 8/2001 Funatsu ..... 439/79
6,435,912 B1 * 8/2002 Zhu et al. ..... 439/607.23
6,482,028 B2 * 11/2002 Kumamoto et al. ..... 439/498
6,817,898 B2 * 11/2004 Tanaka et al. ..... 439/579
6,905,366 B2 * 6/2005 Yang ..... 439/607.15
6,935,870 B2 8/2005 Kato et al.
7,128,617 B2 * 10/2006 Wang et al. ..... 439/660
7,232,346 B2 6/2007 Hu et al.
7,413,467 B1 * 8/2008 Lai et al. ..... 439/489
7,667,138 B2 * 2/2010 Koga ..... 174/110 R
7,704,081 B2 * 4/2010 Swanger et al. ..... 439/79
7,708,601 B2 * 5/2010 Tanaka ..... 439/660
7,806,704 B2 * 10/2010 Miyoshi et al. ..... 439/108
7,841,905 B2 * 11/2010 Zheng et al. ..... 439/660
2005/0048846 A1 * 3/2005 Suzuki et al. ..... 439/660
2010/0248515 A1 * 9/2010 Kondo et al. ..... 439/218

* cited by examiner

*Primary Examiner* — Neil Abrams
(74) *Attorney, Agent, or Firm* — Wei Te Chung; Andrew C. Cheng; Ming Chieh Chang

(57) ABSTRACT

An electrical connector comprises an insulative housing having a base portion, a tongue portion extending forwardly from the base portion, the tongue portion being thinner than the base portion; a metal shell attached to the base portion to enclose the tongue portion to define a receiving room therebetween; a plurality of contacts including a plurality of first contacts and a plurality of second contacts, the first contacts each defining a first contacting arm and a first soldering leg, the second contacts each defining a second contacting arm and a second soldering leg; and wherein the first soldering legs and the second soldering legs are arranged in one row, the contacts at least include a first pair of differential contacts adjacent to each other, a second pair of differential contacts adjacent to each other, a pair of ground contacts adjacent to each other and positioned between the first pair of differential contacts and the second pair of differential contacts.

20 Claims, 15 Drawing Sheets

ELECTRICAL CONNECTOR WITH IMPROVED ARRANGEMENT OF GROUND AND SIGNAL CONTACTS

BACKGROUND OF THE INVENTION

1. Field of the invention

The present invention generally relates to an electrical connector and more particularly to an electrical connector having improved contacts.

2. Description of Related Art

USB (Universal Serial Bus (USB) connectors are widely adopted to connect electronic devices such as digital cameras, mobile phones and the like to a computer. The design of USB is standardized by the USB Implementers Forum (USB-IF) and has been under development for years. The recent design of the USB is USB 3.0 (SuperSpeed USB) which is disclosed in the USB 3.0 specification released on Nov. 17, 2008 by the USB-IF. The USB 3.0 Specification has been available on website: http://www.usb.org/developers/docs/. Compared to an USB 2.0 connector, five additional contacts are added to the USB 3.0 standard A-type connector, thereby increasing transfer rate. The USB 3.0 standard A-type connector comprises a receiving opening to accommodate a corresponding plug, a tongue plate extending into the receiving opening, a metal shell enclosing the tongue plate to form said receiving opening, a plurality of first contacts and a number of second contacts which are mounted on a same side of the tongue plate and exposed to the receiving opening. However, according to the USB 3.0 Specification, soldering legs of the first contacts and the second contacts are arranged in a front row and a rear row respectively, in this manner, all the soldering legs are not positioned in a desirable way to cooperate with each other to decrease crosstalk.

It is thus desired to provide an electrical connector having an improved soldering leg.

SUMMARY OF THE INVENTION

According to one aspect of the present invention, an electrical connector to be mounted on a printed circuit board, comprising: an insulative housing having a base portion, a tongue portion extending forwardly from the base portion, the tongue portion being thinner than the base portion and defining a front face, a lower side face and an upper side face opposite to the first side face; a metal shell attached to the base portion to enclose the tongue portion to define a receiving room therebetween, and defines a top wall, bottom wall and a pair of side walls, a first receiving room being formed between the bottom wall and the lower side face, a second receiving room being formed between the top wall and the upper side face; a plurality of contacts including a plurality of first contacts and a plurality of second contacts, the first contacts each defining a first contacting arm and a first soldering leg, the second contacts each defining a second contacting arm and a second soldering leg; and wherein both the second contacting arms and the first contacting arms are located on a same side of the upper side face to be exposed to the first receiving room, the first soldering legs and the second soldering legs are arranged in one row, the contacts at least include a first pair of differential contacts adjacent to each other, a second pair of differential contacts adjacent to each other, a pair of ground contacts adjacent to each other and positioned between the first pair of differential contacts and the second pair of differential contacts.

According to another aspect of the present invention, An electrical connector to be mounted on a printed circuit board, comprising: an insulative housing having a base portion, a tongue portion extending forwardly from the base portion, the tongue portion being thinner than the base portion and defining a front face, a lower side face and an upper side face opposite to the first side face; a metal shell attached to the base portion to enclose the tongue portion to define a receiving room therebetween, and defines a top wall, bottom wall and a pair of side walls, a first receiving room being formed between the bottom wall and the lower side face, a second receiving room being formed between the top wall and the upper side face; a plurality of contacts including a plurality of first contacts and a plurality of second contacts, the first contacts each defining a first contacting arm and a first soldering leg, the second contacts each defining a second contacting arm and a second soldering leg; and wherein both the second contacting arms and the first contacting arms are located on a same side of the upper side face to be exposed to the first receiving room, the first soldering legs and the second soldering legs are arranged in one row, the second contacts includes a second ground contact having a pair of said second soldering legs which are spaced from each other along a lateral direction, all the first soldering legs of the first contacts are positioned between the pair of said second soldering legs of the ground contact of the second contacts.

Other objects, advantages and novel features of the present invention will become more apparent from the following detailed description of the present embodiment when taken in conjunction with the accompanying drawings.

DETAILED DESCRIPTION OF THE INVENTION

Figure 1:
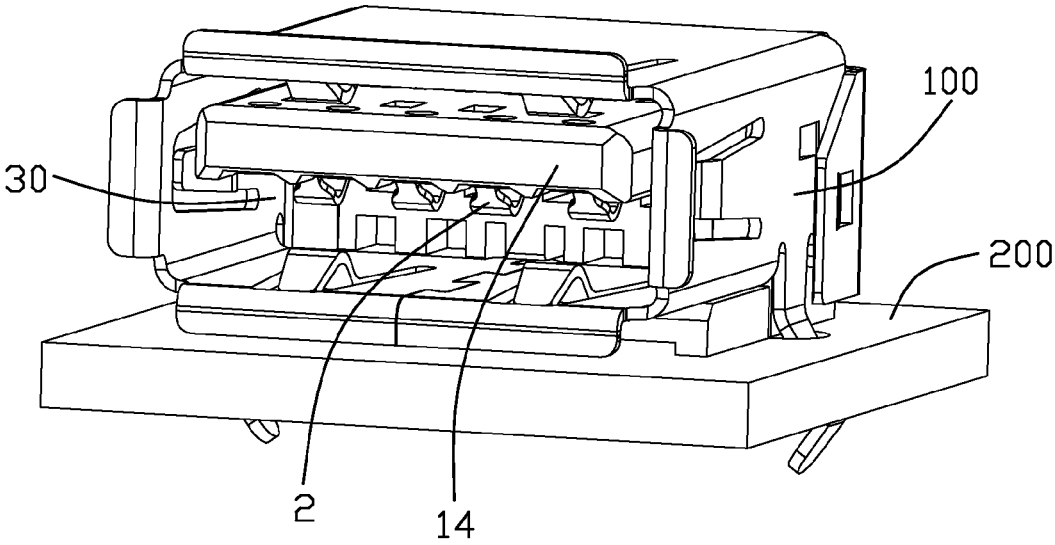
FIG. 1 is an assembled perspective view of an electrical connector mounted on a printed circuit board according to a first embodiment of the present invention.

Reference will now be made to the drawing figures to describe the preferred embodiment of the present invention in detail.

Figure 2:
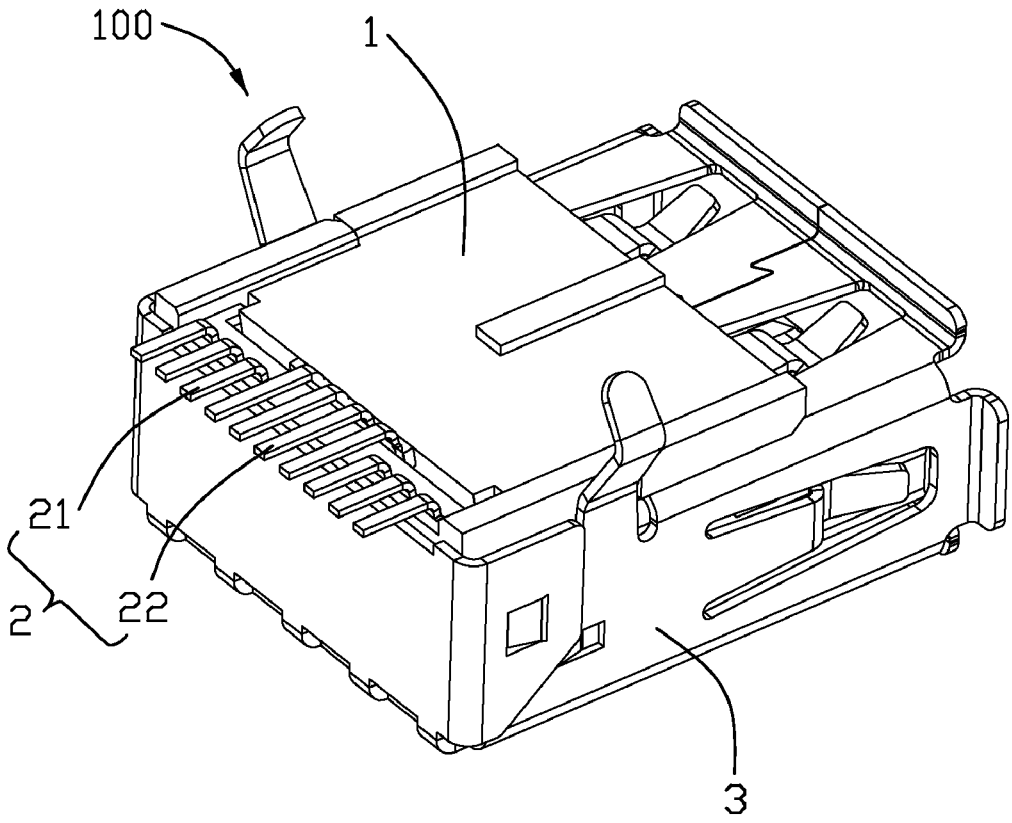
FIG. 2 is perspective view of the electrical connector shown in FIG. 1.
Figure 3:
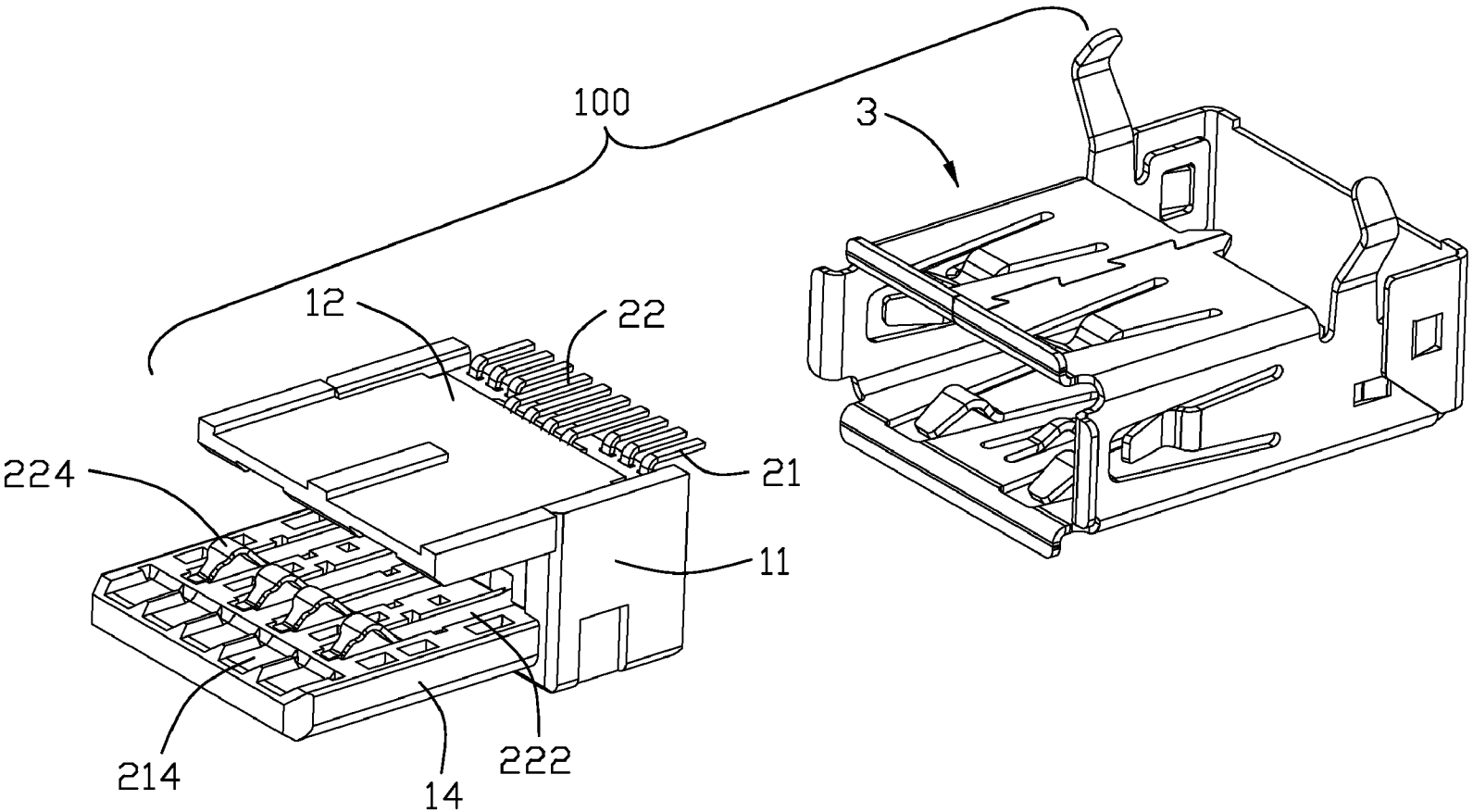
FIG. 3 is a partly exploded perspective view of the electrical connector.
Figure 4:
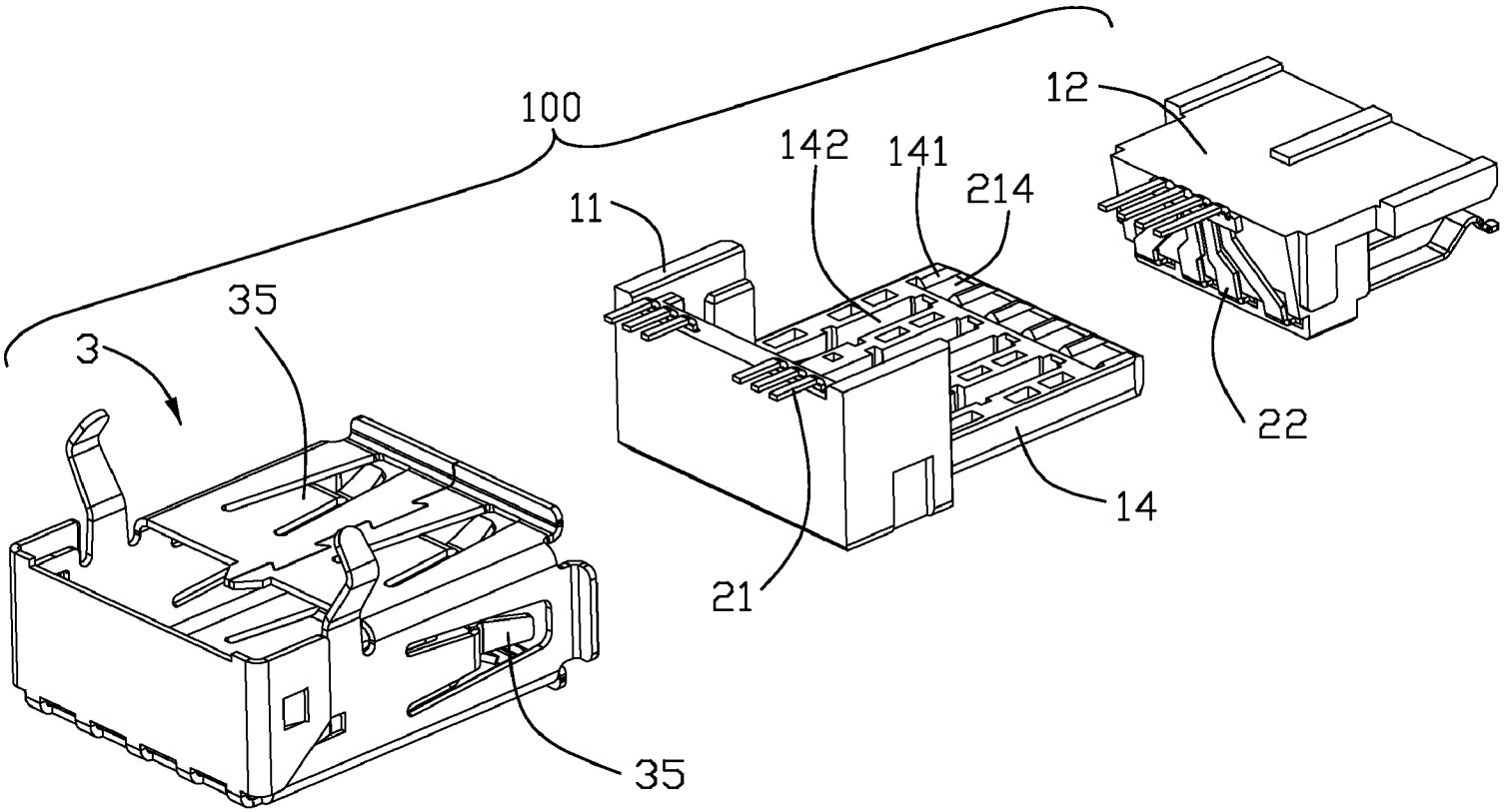
FIG. 4 is a view similar to FIG. 3, while taken from a different aspect.
Figure 5:
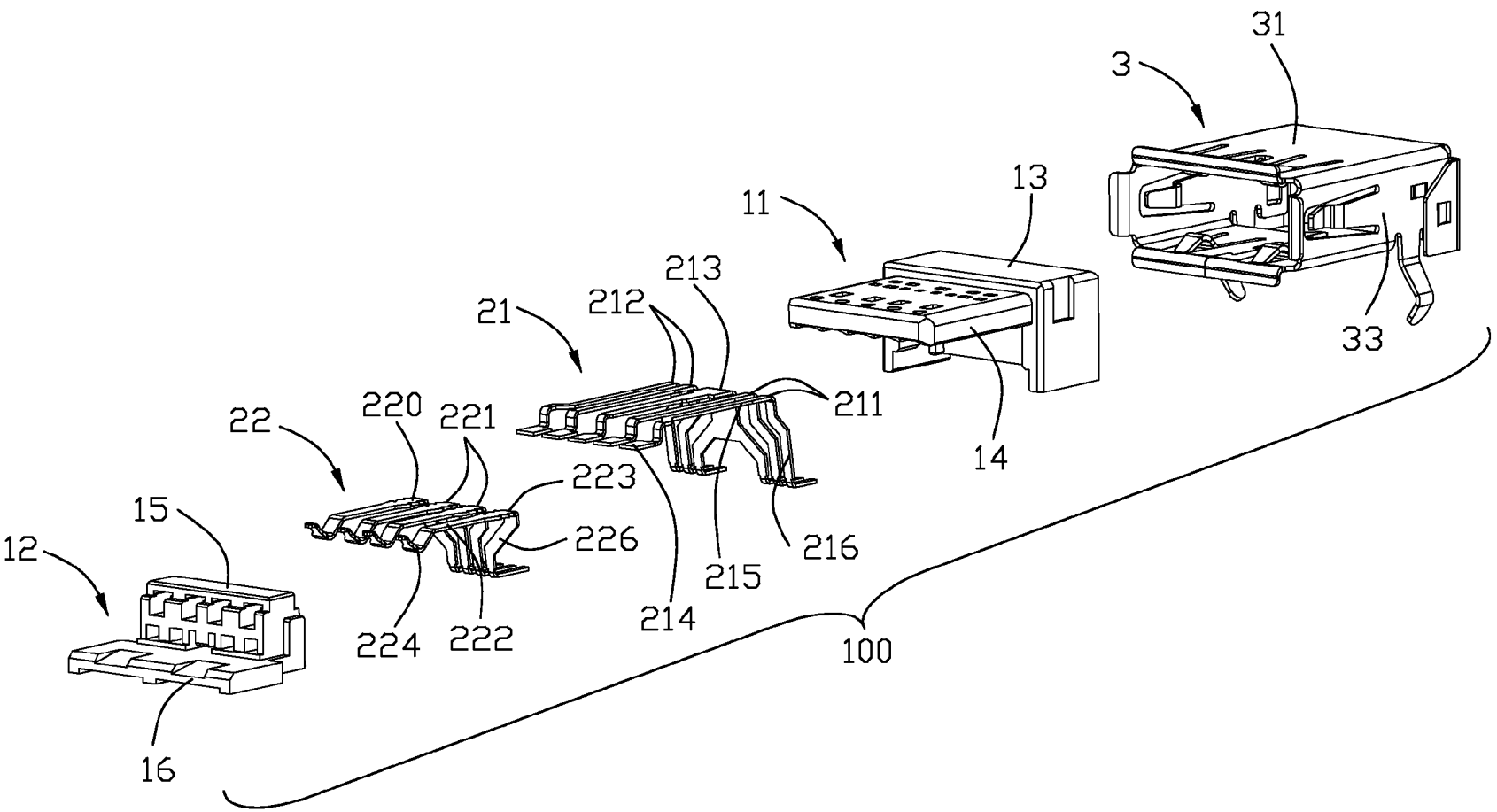
FIG. 5 is an exploded perspective view of the electrical connector.
Figure 6:
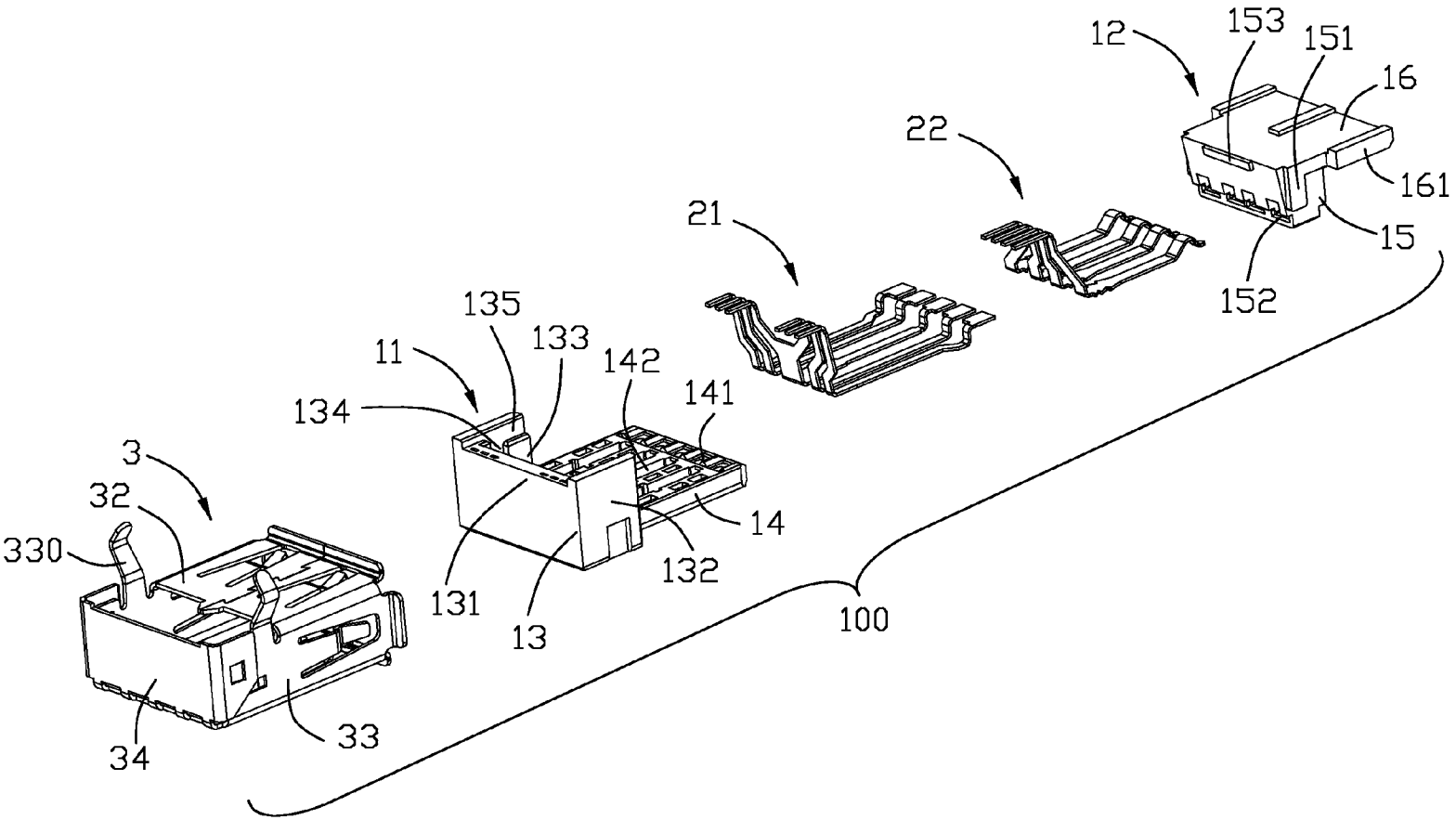
FIG. 6 is a view similar to FIG. 5, while taken from a different aspect.

Referring to FIGS. 1-6, an electrical connector 100 is preferably an USB 3.0 receptacle mounted on a mother PCB 200 to transmit USB 2.0 or USB 3.0 signals. The electrical connector 100 includes an insulative housing 1, a plurality of contacts 2 held in the insulative housing 1, a metal shell 3 enclosing the insulative housing 1. The electrical connector 100 defines a mounting face to be mounted onto the PCB 200 and a front mating face to mate with an USB 2.0 plug or an USB 3.0 plug.

The shell 31 defines a top wall 31, bottom wall 32, and a pair of side walls 33 connecting with both the top wall 31 and the bottom wall 32. The insulative housing 1 includes a base portion 13 and a tongue portion 14 extending forwardly from a front face of the base portion 13 to be thinner than the base portion 13. A receiving room 30 is formed between the metal shell 3 and the tongue portion 14 to accommodate a corresponding plug. The tongue portion 14 is spaced from the top wall 31 with a first distance and spaced from the bottom wall 32 with a second distance which is larger than the first distance.

The contacts 2 includes a plurality of first contacts 22 (USB 2.0 pins) and a plurality of second contacts (SuperSpeed pins) 21, the first contacts 22 include four contacts which are arranged in an order of a power contact (designated Vbus or 220), a third pair of differential contacts adjacent to each other (respectively designated S, S or 221), and a ground contact (designated G or 223). The first contacts 22 each comprises a first contacting arm 222, a first soldering leg 227, 228, 229 to be soldered with the PCB 200 via surface mount technology, a first connection plate 226 arranged in a first vertical plane to connect the first contacting arm 222 and the first soldering leg 227, 228, 229. The first contacting arm 222 is provided with a flexible contacting portion 224 on a substantially distal end thereof and a number of retention portions such as barbs 230 on a rear end thereof.

The second contacts 21 is added to the electrical connector 100 to enhance data transmission capability. The second contacts 21 are insert molded with the tongue portion 14 and include a first pair of differential signal contacts adjacent to each other (respectively designated S, S or 211), a second pair of differential contacts adjacent to each other (respectively designated S, S or 212) and a ground contact (designated G or 213) positioned therebetween. The second contacts 21 each comprises a second contacting arm 214, a second soldering leg 217, 218 to be soldered with the PCB 200 via surface mount technology, a second connection plate 216 arranged in a second vertical plane to connect the second contacting arm 214 and the second soldering leg 217, 218. The second contacting arm 214 is provided with a flat non-elastic contacting portion on a front end thereof.

The tongue portion 14 has a front face, an upper side face and a lower side face opposite to the upper side face. The first contacting arm 222 projects downwardly beyond the lower side face. Four first passageways 142 is recessed from the lower side face to receive the first contacts 22. A first receiving room is formed between the bottom wall 32 and the lower side face of the tongue portion 14, a second receiving room is formed between the top wall 31 and the upper side face of the tongue portion 14. Both the second contacting arms 214 and the first contacting arms 222 are positioned on a same side of the tongue portion 14 to be exposed to the first receiving room. The second contacting arms 214 are flat and non-elastic, the first contacting arms 222 are elastic and deflectable along a height direction of the tongue portion 14. The first contacting arms 222 are arranged in a first row, the second contacting arms 214 are arranged in a second row which is located in front of the first row. The flexible contacting portions 224 are located below flat non-elastic contacting portions of the second contacting arm 214.

The lower side face of the tongue portion 14 is provided with five second passageways 141 for receiving the second contacting arms 214, the second passageways 141 is arranged in front of the first passageways 142. The first soldering legs 227, 228, 229 and the second soldering legs 218, 217 are arranged in one row. Soldering legs of the two ground contacts 217, 227 are positioned between soldering legs 218 of the first pair of differential contacts 211 and soldering legs 228 of the third pair of differential contacts 221. All the soldering legs 227, 228, 229 of the first contacts 22 are positioned between inner sides of all the soldering legs 218, 217 of the second contacts 21. Soldering legs 227, 228, 229 of the first contacts 22 each has a length longer than that of each soldering legs 218, 217 of the second contacts 21. All the soldering legs 227, 228, 229 of the first contacts 22 are located in an inner side of the contacting arms 222 of the ground contact 223 and the power contact 220 of the first contacts 22 and are positioned on a rear and a bottom side of all the contacting arms 222 of the first contacts 22.

The soldering legs 227, 228, 229 of the first contacts 22 are arranged in an order of G, S, S, Vbus from left side to right side when the electrical connector 100 is viewed from a rear perspective thereof. The second soldering legs 218, 217 of the second contacts 2 are arranged in an order of S, S, G, G, S, S from left side to right side when the electrical connector 100 is viewed from a rear perspective thereof. All the soldering legs of the first contacts 22 and the second contacts 21 are arranged in an order of S, S, G, G, S, S, Vbus, G, S, S from left side to right side when the electrical connector 100 is viewed from a rear perspective thereof.

The first connection plate 226 are arranged in a first vertical plane, the second connection plate 216 are positioned on a rear side of the first connection plate 226 and arranged in a second vertical plane which is parallel to the second plane. The second connection plate 216 of the ground contact 213 has an enlarged portion 2161 on an upper portion thereof. The second connection plate 216 of the ground contact 213 has a shape of tuning fork and includes a left arm 2162 and a right arm 2163 on a lower end thereof, the left arm 2162 and the right arm 2163 sideward and outwardly from an opposite sides of the enlarged portion 2161, the second soldering legs 217 of the ground contact 213 includes a pair of sub-legs spaced from each other and connected to the left arm 2162 and the right arm 2161 respectively.

The second connecting plates 216 of the second contacts 21 include a second upper vertical plate and a second lower vertical plate and a second inclined plate connecting the second upper vertical plate and the second lower vertical plate, the second inclined plate extends inwardly.

A receiving cavity 133 is recessed upwardly on the base portion 13 to retain a spacer 12 of right angle, the spacer 4 has an vertical portion 15 and a lateral portion 16 which is parallel to the tongue portion 14 and located beneath the tongue portion 14 to support the bottom wall 32 of the shell 3. Four through holes 152 are formed on the vertical portion 15 to retain the first contacts 22. The vertical portion 15 defines a pair of latching arms 151 to be fixed on a corresponding recess 134 on side wall 132 of the base portion 13.

The shell 3 is provided with a plurality of spring tabs 35 extending into the receiving room 30 to abut against a corresponding plug. The side face 33 of the shell 3 is formed with a soldering leg 330 soldered to the PCB. A rear face 34 of the shell 3 extends vertically and downwardly from the upper wall 31 to abut against a rear wall 151 of the vertical portion 15.

Figure 7:
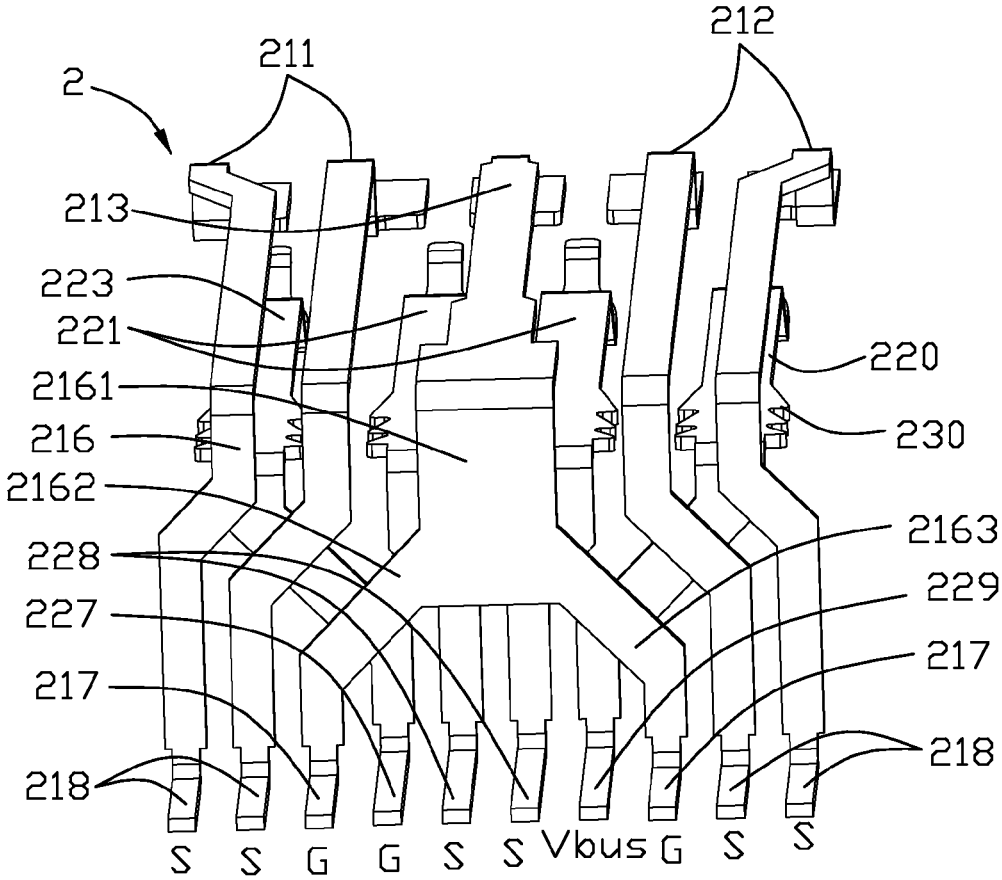
FIG. 7 is a rear perspective view of first contacts and second contacts of the electrical connector.
Figure 8:
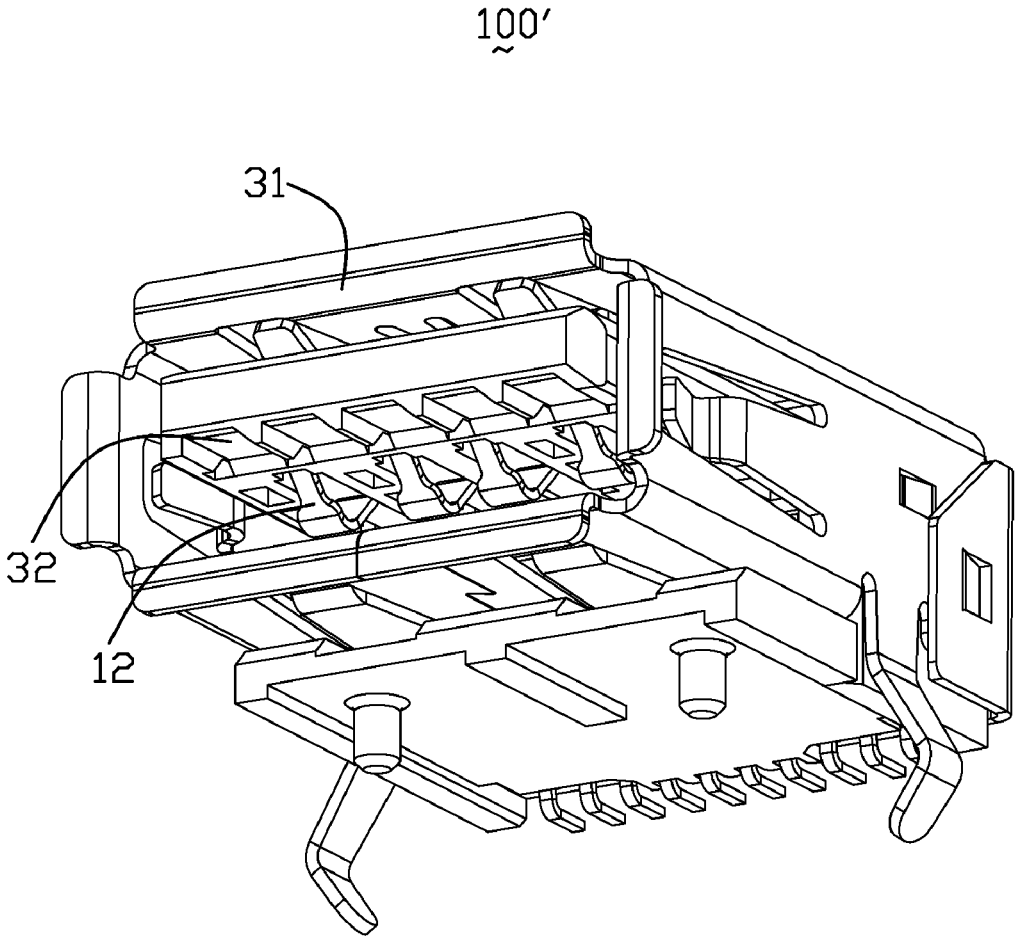
FIG. 8 is an assembled perspective view of an electrical connector according to a second embodiment of the present invention.
Figure 9:
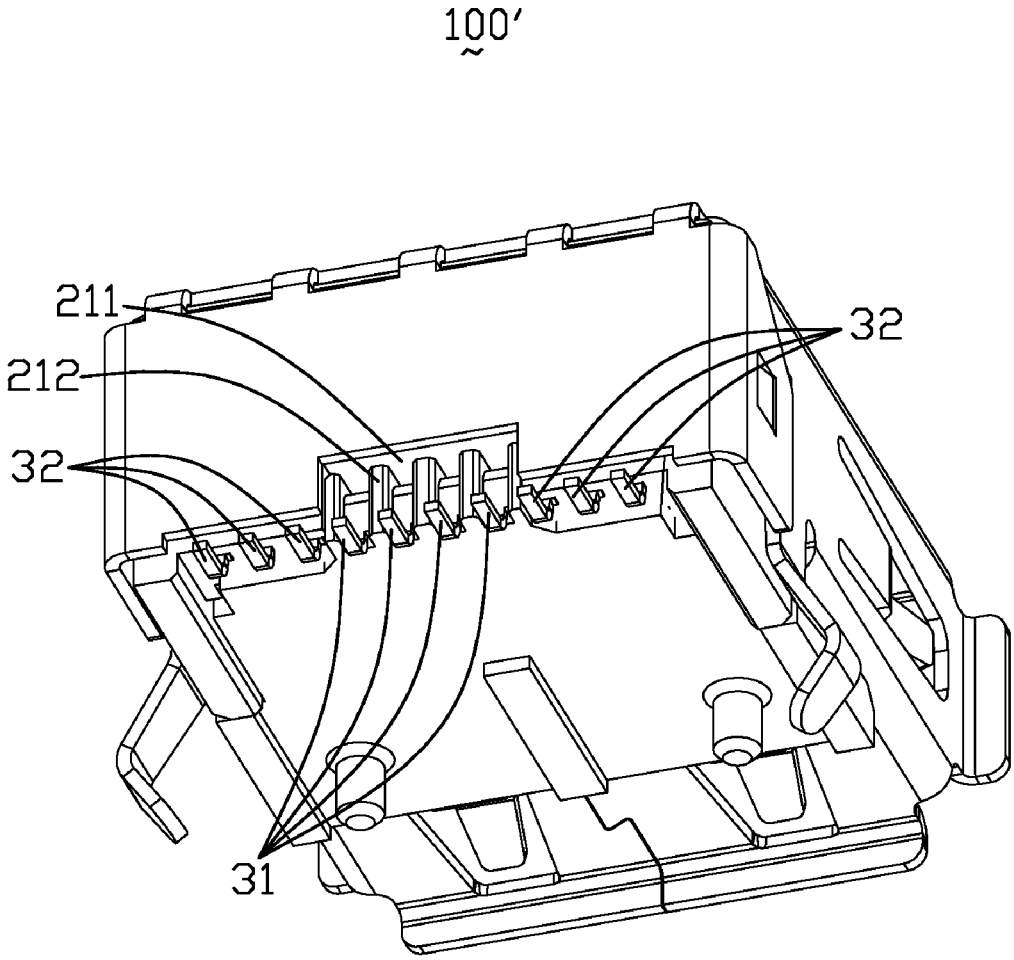
FIG. 9 is a rear perspective view of the electrical connector shown in FIG. 8.
Figure 10:
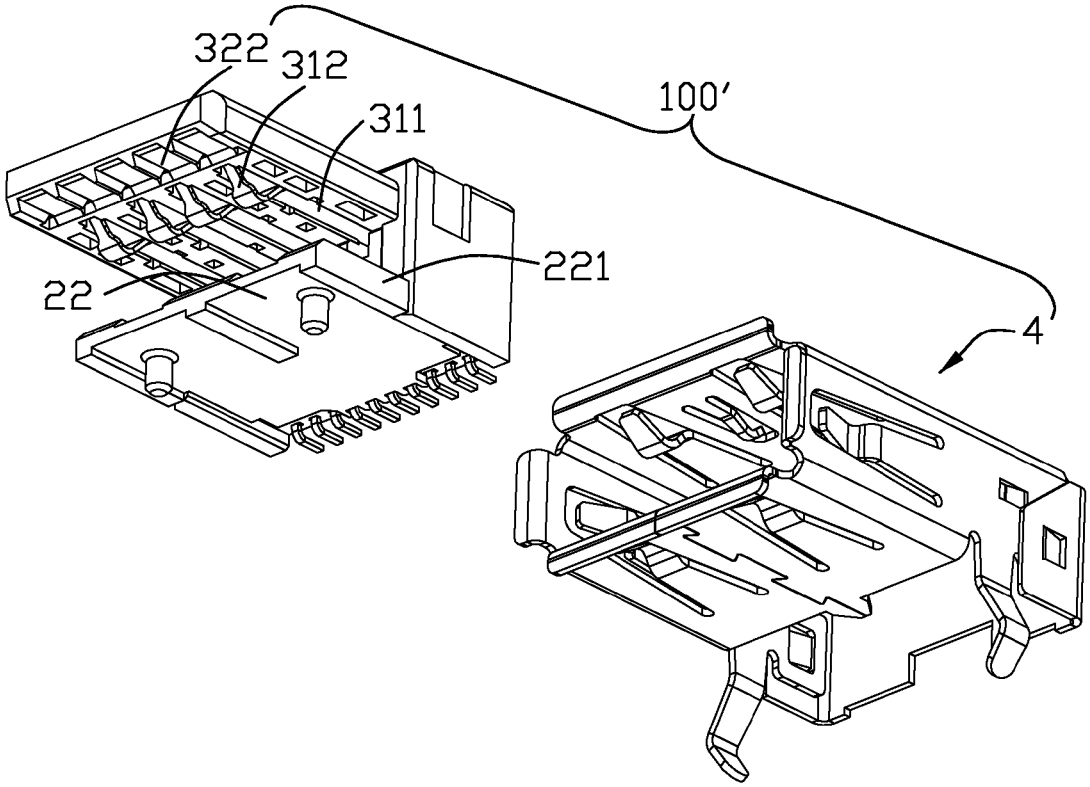
FIG. 10 is a partly exploded perspective view of the electrical connector shown in FIG. 8.
Figure 11:
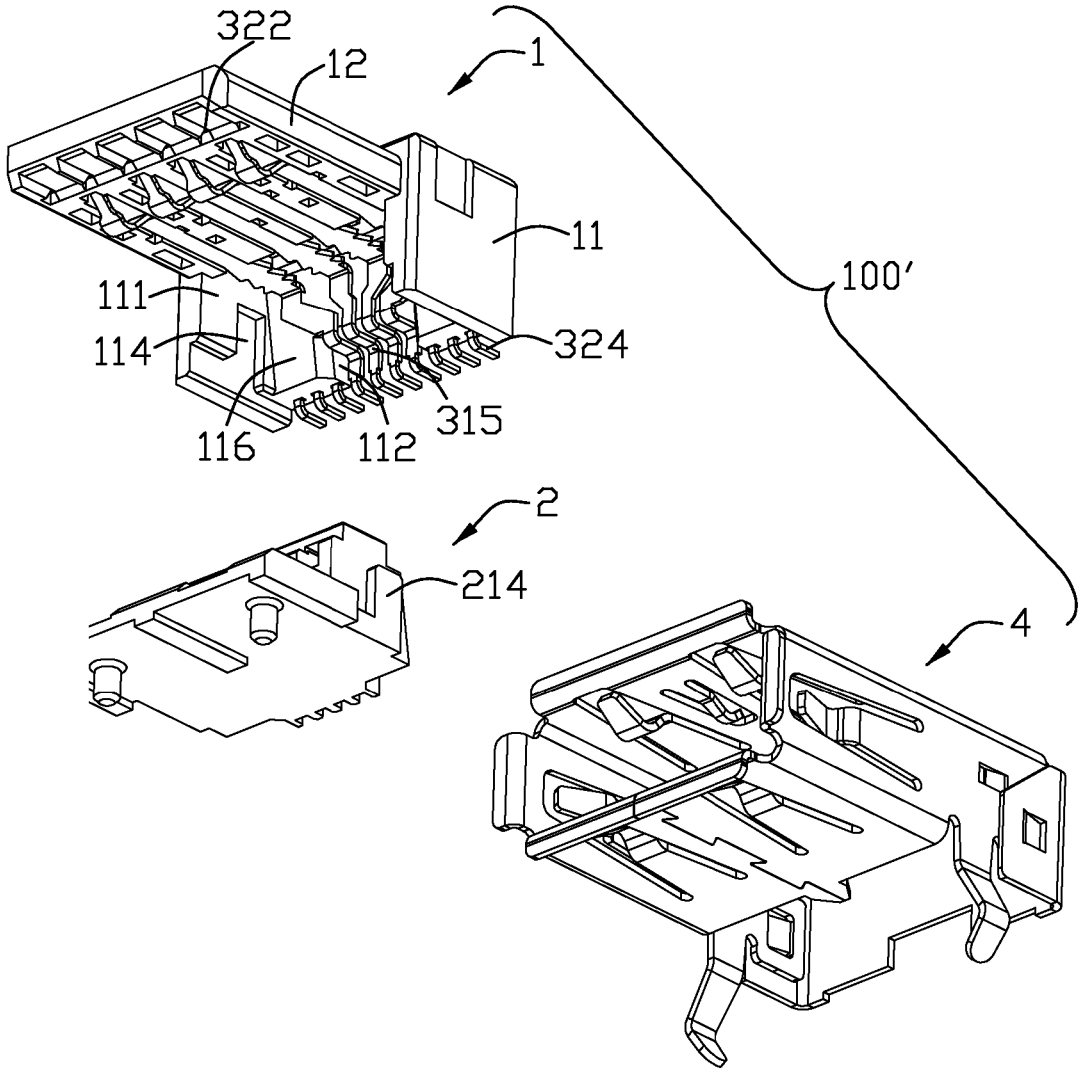
FIG. 11 is another partly exploded perspective view of the electrical connector.
Figure 12:
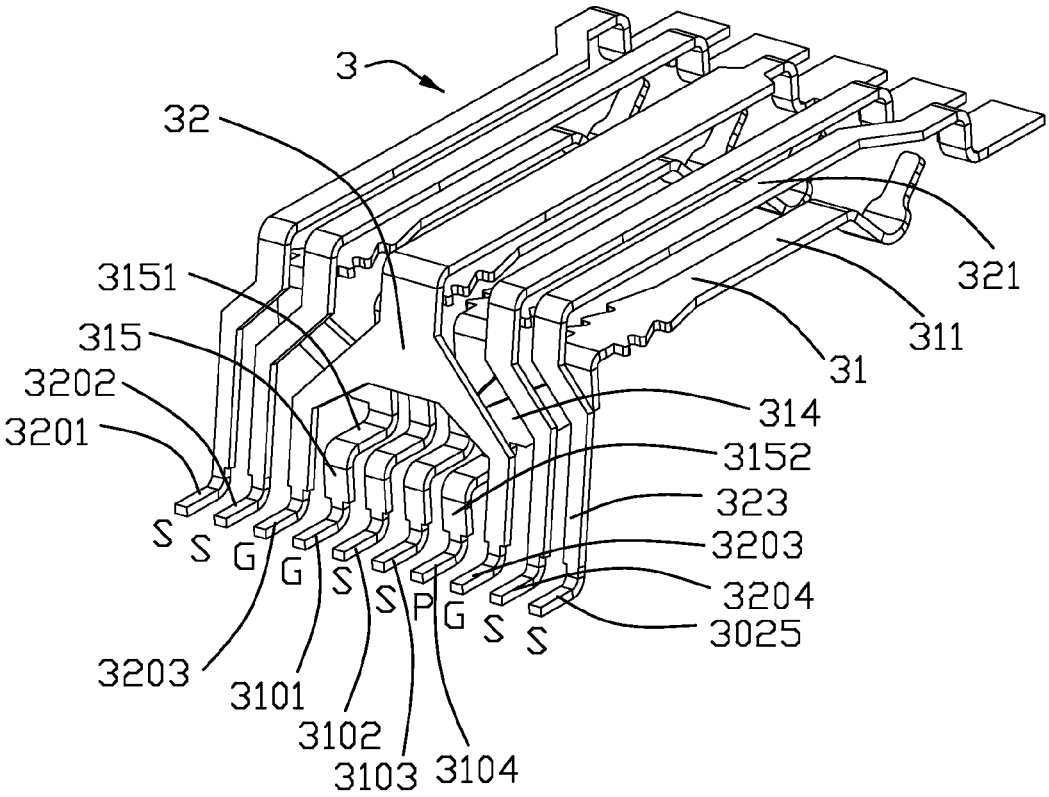
FIG. 12 is an exploded perspective view of the electrical connector.
Figure 13:
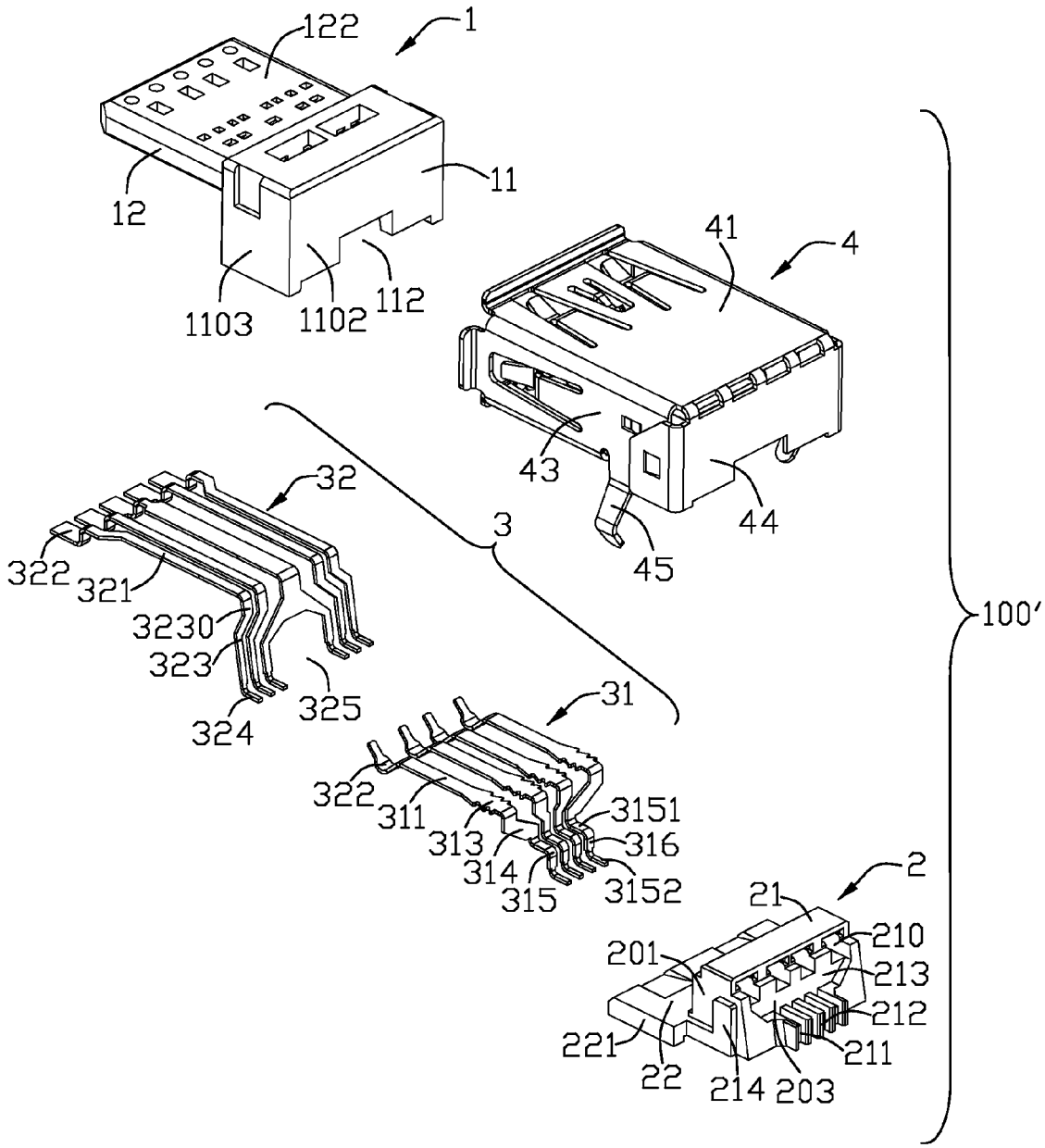
FIG. 13 is a view similar to FIG. 12, while taken from a different aspect.
Figure 14:
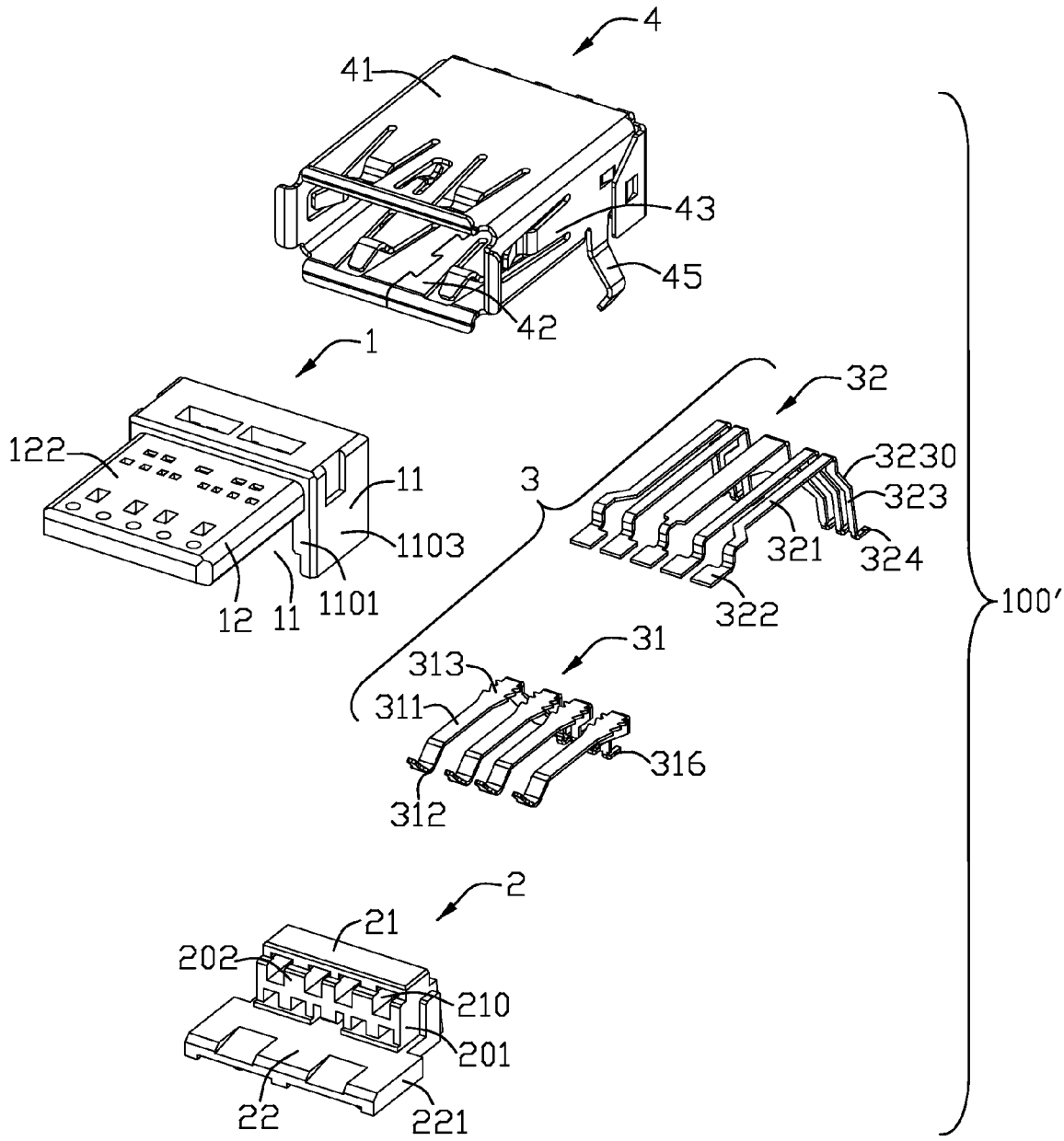
FIG. 14 is a view similar to FIG. 13, while taken from a different aspect.
Figure 15:
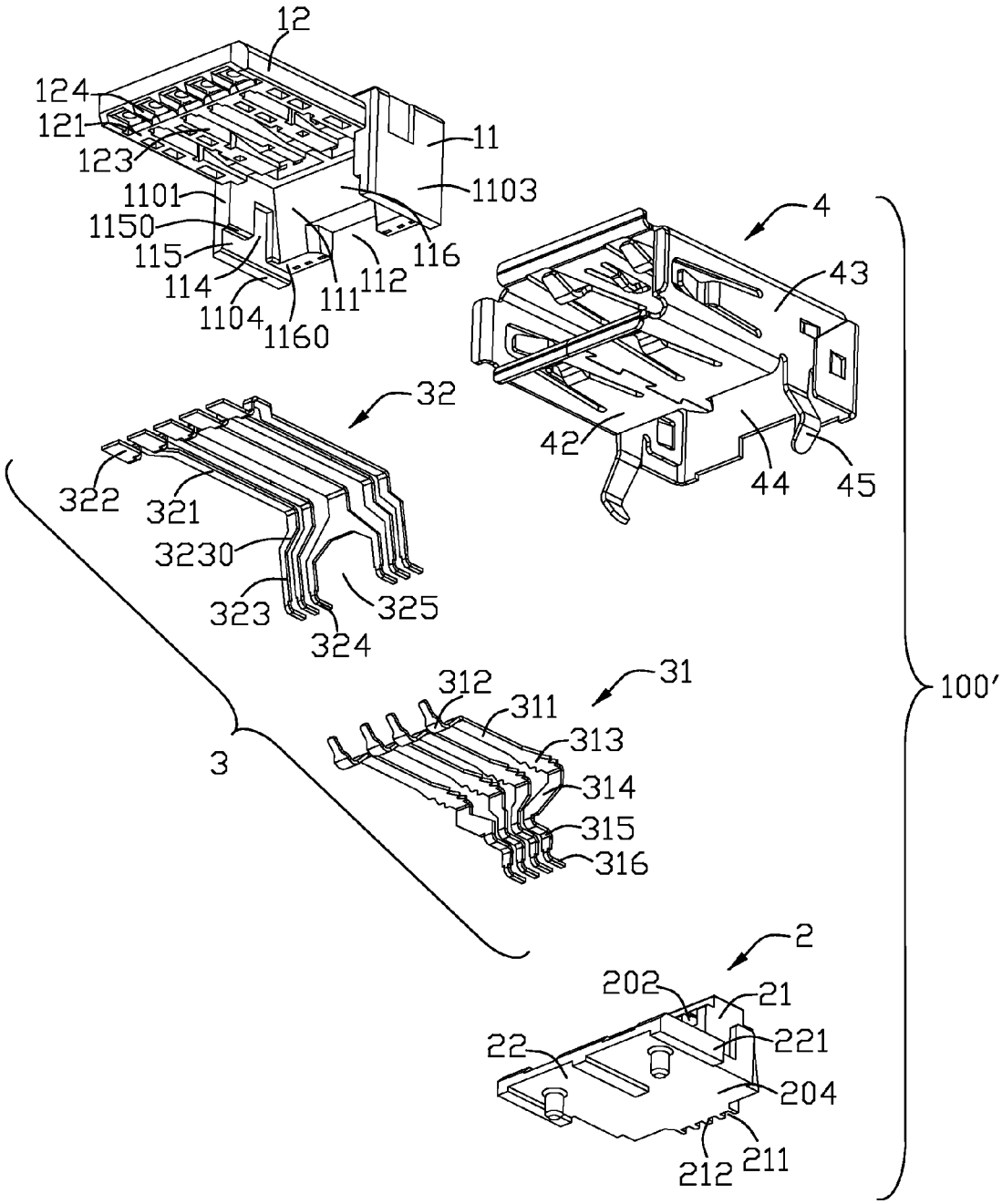
FIG. 15 is a perspective view of first contacts and second contacts of the electrical connector shown in FIG. 8.

Referring to FIGS. 8-15, a second embodiment of the electrical connector 100' is similar to the first embodiment shown in FIGS. 1-7, and differs in that the first connection plate 315 of the first contact 31 is further provided with a level portion 3151 to connect the first lower vertical plate 316 and the first inclined plate 314, the level portion 3151 is parallel to and located on an upper and front side of all the soldering legs 3210, 3202, 3203, 3101, 3102, 3103, 3104, 3204, 3205. All the soldering legs 3210, 3202, 3203, 3101, 3102, 3103, 3104, 3204, 3205 of the first contacts 31 and the second contacts 32 have a same length.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector to be mounted on a printed circuit board, comprising:

an insulative housing having a base portion, a tongue portion extending forwardly from the base portion, the tongue portion being thinner than the base portion and defining a front face, a lower side face and an upper side face opposite to the first side face;

a metal shell attached to the base portion to enclose the tongue portion to define a receiving room therebetween, and defines a top wall, bottom wall and a pair of side walls, a first receiving room being formed between the bottom wall and the lower side face, a second receiving room being formed between the top wall and the upper side face;

a plurality of contacts including a plurality of first contacts and a plurality of second contacts, the first contacts each defining a first contacting arm and a first soldering leg, the second contacts each defining a second contacting arm and a second soldering leg; and wherein both the second contacting arms and the first contacting arms are located on a same side of the upper side face to be exposed to the first receiving room, the first soldering legs and the second soldering legs are arranged in one row, the second contacts includes a second ground contact having a pair of said second soldering legs which are spaced from each other along a lateral direction, all the first soldering legs of the first contacts are positioned between the pair of said second soldering legs of the ground contact of the second contacts.

2. The electrical connector as claimed in claim 1, wherein the first soldering legs of the first contacts are arranged in an order of G, S, S, Vbus from left side to right side when the electrical connector is viewed from a rear perspective thereof.

3. The electrical connector as claimed in claim 1, wherein the second soldering legs of the second contacts are arranged in an order of S, S, G, G, S, S from left side to right side when the electrical connector is viewed from a rear perspective thereof.

4. The electrical connector as claimed in claim 1, wherein the first contacts each includes a first connection plate arranged in a first plane to connect the first contacting arm and the first soldering leg, the second contacts each includes a second connection plate arranged in a second plane to connect the second contacting arm and the second soldering leg, the first plane is parallel to the second plane which on a rear side of the first plane.

5. The electrical connector as claimed in claim 4, wherein the second connection plate of the second ground contact has an enlarged portion on an upper portion thereof, the second connection plate of the second ground contact has a left arm and a right arm on a lower end thereof, the left arm and the right arm sideward and outwardly from opposite sides of the enlarged portion, the soldering leg of the second ground contact includes a pair of sub-legs spaced from each other and being connected to the left arm and the right arm respectively.

6. The electrical connector as claimed in claim 4, wherein the first connecting plates of the first contacts included a first upper vertical plate and a first lower vertical plate and a first inclined plate connecting the first upper vertical plate, a level portion to connect the first lower vertical plate and the first inclined plate, the level portion is parallel to and located on an upper and front side of all the soldering legs of the first contacts and the second contacts, the level portion is positioned in a front side of the second connecting plates, the first soldering legs and the second soldering legs have a same length.

7. An electrical connector comprising:

an insulative housing defining a mating port with therein a forwardly extending mating tongue which defines thereon a mating face facing in a vertical direction;

a plurality of first contacts disposed in the housing each with a stiff first contacting section exposed upon the mating face, and a first solder section exposed upon a rear face of the housing; and a plurality of second contacts disposed in the housing each with a resilient second contact section exposed upon the mating face with an offset manner relative to the first contact section in a front-to-back direction perpendicular to the vertical direction, and a second solder section exposed upon the rear face of the housing; wherein all the first solder sections are divided with two groups symmetrically sandwich all the second solder sections therebetween in a transverse direction perpendicular to said front-to-back direction and said vertical direction.

8. The electrical connector as claimed in claim 7, wherein one of said first contacts defines two split solder sections sandwiching said second solder sections therebetween in said transverse direction.

9. The electrical connector as claimed in claim 8, wherein each of said first contacts includes a portion extending toward the other face of the mating tongue opposite to the mating face and is essentially higher than each of second contacts in the vertical direction.

10. The electrical connector as claimed in claim 7, wherein the first solder sections are arranged in a diverging manner with the second soldering sections are arrange in a converging manner.

11. An electrical connector comprising:

an insulative housing defining a mating port with therein;

a plurality of first contacts disposed in the housing, each of said first contacts defining a first contacting arm exposed in the mating port, and a first solder section disposed around a rear face of the housing; and a plurality of second contacts disposed in the housing, each of said second contacts configured essentially different from the first contact, and defining a second contacting arm exposed in the mating port and essentially located at a different level with regard to the first contacting arm, and a second solder section disposed around the rear face of the housing; wherein some of the first solder sections are arranged in one row in a transverse direction while being divided with two opposite groups to essentially symmetrically sandwich some of the second solder sections, which are also arranged in said row, therebetween along said transverse direction; wherein one of said first contacts, which performs a grounding function, unitarily defines two split said solder sections spaced from each other in said transverse direction and respectively belonging to said two opposite groups while being two innermost ones directly neighboring to said some of the second solder sections in said transverse direction so as to commonly intimately and directly sandwich said some of the second solder sections therebetween in said transverse direction.

12. The electrical connector as claimed in claim 11, wherein the first contacting arms commonly defines a first contacting region and the second contacting arms commonly defines a second contacting region under condition that the first contacting region and second contacting region are dimensioned similar to each other in said transverse direction.

13. The electrical connector as claimed in claim 12, wherein said first contacting region and said second contacting region are essentially offset from each other in a front-to-back direction perpendicular to said transverse direction.

14. The electrical connector as claimed in claim 11, wherein said housing defines a tongue portion in the mating port, and the first contacting arms and the second contacting arms are commonly exposed upon said tongue portion.

15. The electrical connector as claimed in claim 14, wherein the first contacting arms and the second contacting arms are commonly exposed upon a same face of the mating tongue.

16. The electrical connector as claimed in claim 11, wherein the first contacting arms are stiff while the second contacting arms are resilient.

17. The electrical connector as claimed in claim 11, wherein at least either the first solder sections are arranged in a diverging manner or the second solder sections are arranged in a converging manner.

18. The electrical connector as claimed in claim 17, wherein the second solder sections are essentially arranged, in a side view, in an offset manner along a front-to-back direction perpendicular to said transverse direction, and the second solder sections are converged in one vertical plane while the first solder sections are diverged in another vertical plane behind said vertical plane in said front-to-back direction.

19. The electrical connector as claimed in claim 11, wherein all said first solder sections and all said second solder sections are commonly arranged in said row along said transverse direction.

20. The electrical connector as claimed in claim 11, wherein said second contacting arms are located below the first contacting arms.

* * * * *